US007189018B2

(12) United States Patent
Cercos et al.

(10) Patent No.: US 7,189,018 B2
(45) Date of Patent: Mar. 13, 2007

(54) PRINT MEDIA DRIVE

(75) Inventors: Angel Cercos, Barcelona (ES); Daniel Gonzalez, Terrassa (ES); Alejandro Campillo, Barcelona (ES); Joaquim Veciana, Barcelona (ES); Ezequiel Jordi Rufes, Sant Feliu de Llobregat (ES); Antonio Hinojosa, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 77 days.

(21) Appl. No.: 10/765,073

(22) Filed: Jan. 28, 2004

(65) Prior Publication Data

US 2005/0163553 A1 Jul. 28, 2005

(51) Int. Cl.
*B41J 29/38* (2006.01)

(52) U.S. Cl. ..... 400/578; 347/104

(58) Field of Classification Search ..... 400/624, 400/629, 636, 637, 639; 347/104
See application file for complete search history.

(56) References Cited

U.S. PATENT DOCUMENTS

| | | | | |
|---|---|---|---|---|
| 5,131,770 | A * | 7/1992 | Kanemitsu | 400/568 |
| 6,095,703 | A * | 8/2000 | Tanaka et al. | 400/582 |
| 6,217,143 | B1 * | 4/2001 | Munakata et al. | 347/16 |
| 6,761,425 | B2 * | 7/2004 | Kawaguchi et al. | 347/16 |
| 6,851,802 | B2 * | 2/2005 | Sakakibara et al. | 347/108 |

FOREIGN PATENT DOCUMENTS

| | | | | |
|---|---|---|---|---|
| JP | 05-38853 | A * | 2/1993 | 400/636 |
| JP | 2003231331 | A * | 8/2003 | |

OTHER PUBLICATIONS

Machine translation of JP 2003-231331 to Otuska from Japanese Patent Office website.*

* cited by examiner

*Primary Examiner*—Daniel J. Colilla
(74) *Attorney, Agent, or Firm*—Foley & Lardner LLP

(57) ABSTRACT

In a printing apparatus, in which normal printing occurs in a print zone through which a print media is moved by an input feed roller arrangement and an output overdrive roller arrangement, the desired speed of the print media is maintained during bleed printing in the margin of the print media by altering the drive parameters of at least one of the roller arrangements.

21 Claims, 4 Drawing Sheets

PRINT MEDIA DRIVE

BACKGROUND OF THE INVENTION

The present invention relates to a print media drive arrangement for driving a print media through a print zone located between first and second roller means of a hardcopy apparatus.

When applying ink to a print media such as paper, it is known that the media tends to expand as it absorbs the ink to produce an effect known as "cockle". Unless otherwise constrained, the print media tends to lift away from the underlying printing platen and this causes the spacing between the printheads and the print media to vary, which causes a deterioration in print quality. In extreme cases, the print media may even come into contact with the printheads.

To reduce this problem it is known, see for example U.S. Pat. No. 4,759,649, to provide a so-called overdrive roller arrangement at the exit of the print zone, in which the print media is maintained flat in the print zone by being tensioned by the output rollers being driven slightly faster, or overdriven, compared to the input or feed rollers. Such an overdrive arrangement enables the print media advance movements through the print zone to be accurately controlled. Between successive print media advance movements, the printheads of the hardcopy apparatus apply swaths of ink to the print media.

However, for certain printing tasks, in particular those requiring so-called "bleed" printing, it is necessary for ink to be applied in the top and bottom edge regions, or margins, of a print media. In such cases a problem can arise in that, when printing occurs in such regions, the print media is engaged only by one of the rollers, viz. only the feeder roller in a top margin adjacent to the leading edge of the print media or only the overdrive roller in a bottom margin adjacent to the trailing edge of the print media. This can lead to print media advance movements of reduced size, which cause dark banding in the printing due to overlapping swaths, or to print media advance movements which are too large, thus producing banding in the form of gaps in the printing.

SUMMARY OF THE INVENTION

Certain aspects of the present invention seek to overcome or reduce one or more of the above problems.

According to a first aspect of the present invention, there is provided an arrangement for driving a print media through a hardcopy apparatus comprising a first roller member for feeding the print media to a print zone, a second roller member for removing the print media from the print zone, a drive device arranged to drive the first roller member with first respective drive parameters as the print media passes through the print zone, and arranged to drive the second roller member with second respective drive parameters as the print media passes through the print zone, wherein the drive device is arranged to drive at least one of the roller members with different drive parameters as an edge of said print media passes through the print zone.

The drive parameters may be amount of print media advance, rotational speed and/or applied tractional force. The drive parameters may be changed abruptly, but in preferred arrangements they are changed gradually.

The first roller member is preferably a feed roller and the second roller member is preferably an overdrive roller of a hardcopy apparatus. The term "roller" includes one or more wheels. To maintain satisfactory traction, the print media typically passes between a so-called "pinch" between a roller and a pinch wheel. The term "roller" embraces where appropriate the combination of a roller and an associated pinch wheel.

A detector may be provided for detecting the trailing edge of said print media as it enters the print zone, said detector causing said drive device to change at least said second drive parameters. The detector is preferably an optical detector.

The second roller member may have a position encoder device for controlling the drive device. The position encoder device may be used to emit signals intermittently (e.g. once per revolution) to enable the drive device to control the second roller member in a way which takes into account imperfections in the second roller member such as variations in its diameter. Alternatively, the position encoder device may be used to emit signals substantially continuously during rotation to enable the drive device to control the second roller member such as to take into account errors in the drive mechanism in addition to imperfections in the second roller member.

According to a second aspect of the present invention, there is provided a method of printing adjacent the trailing edge of a print media using a print media drive arrangement in accordance with the first aspect in which the second roller member has a position encoder device for controlling said drive device, wherein, as a trailing edge of said media reaches the print zone, a print media advance movement is undertaken controlled by a drive mechanism for the first roller member, the current setting of said position encoder device is then determined, and subsequent media advance movements are undertaken controlled by said position encoder device.

According to a third aspect of the present invention, there is provided an arrangement for driving a print media through a hardcopy apparatus comprising a first roller member for feeding the print media to a print zone, a second roller member for removing the print media from the print zone, and a drive device for driving the first and second roller members at a predetermined transmission ratio as the print media passes through the print zone wherein said transmission ratio is varied as an edge of said print media passes through the print zone.

According to a fourth aspect of the present invention, there is provided a hardcopy device comprising at least one printhead arranged to apply ink to a print media and means for moving a print media past said printhead, said media moving means comprising a first roller member for moving the print media towards said printhead and a second roller member for moving the print media away from said printhead, drive means for operating said roller members with respective drive parameters, the arrangement being such that, when an edge of a print media is between said roller members, at least one of said drive parameters is different from when a print media extends fully between said roller members.

According to a fifth aspect of the present invention, there is provided a method of printing the margin of a print media passing through the print zone of a hardcopy apparatus, comprising moving the print media into the print zone with first drive parameters, moving the print media out of the print zone with second drive parameters, and changing at least one of said drive parameters when an edge of the print media enters or leaves the print zone.

"Bleed printing" is defined as printing in the regions of the print media which, in normal printing, would constitute regions free of printed matter forming the top and bottom margins of the print media. Bleed printing, so-called because the ink "bleeds" off the edge of the print media, is desirable to enable the production of images without interruption.

The term "transition" as used herein means, according to context, the time period or the spatial region in which printing changes between a normal operation in the main region of a print media and a special operation in an end region of the print media. The transition may be a gradual process or it may occur substantially instantaneously. It will be appreciated that "transitions" occur at both ends of a print media.

BRIEF DESCRIPTION OF THE DRAWINGS

Preferred embodiments of the present invention will now be described, by way of example only, with reference to the accompanying drawings of which.

DESCRIPTION OF THE EXEMPLARY EMBODIMENTS

Figure 1:
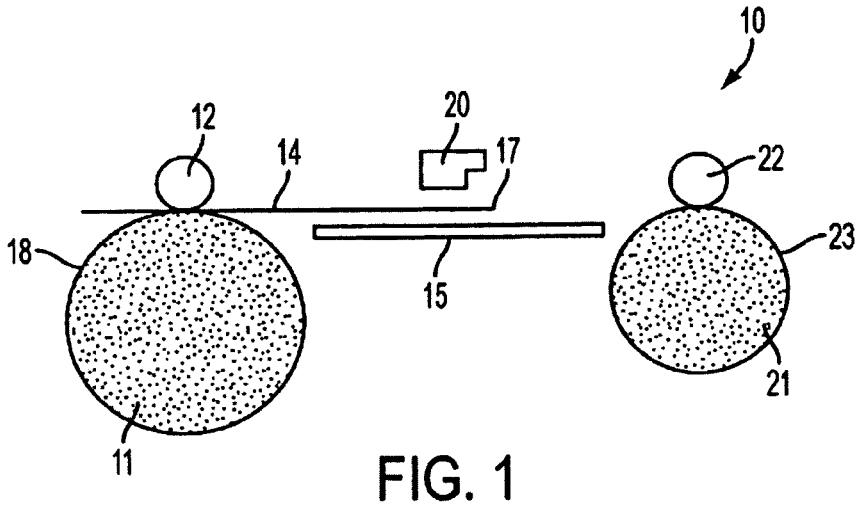
FIG. 1 PRIOR ART
FIG. 1 shows a schematic side view of a print media drive arrangement in accordance with the prior art showing the leading edge of a print media passing through the print zone of a hardcopy apparatus.

Referring now to the drawings, a prior art print media drive arrangement 10, FIG. 1, for an ink-jet printer comprises a feed roller 11, which in conjunction with an associated pinch wheel 12 feeds a print media 14 onto a platen 15 forming the print zone of the printer. FIG. 1 shows an initial stage preceding a printing operation in which the leading edge 17 of print media has passed through the pinch between feed roller 11 and pinch wheel 12 and is advancing through the print zone. At the stage shown in FIG. 1, the print media is advanced solely by the feed roller arrangement 11, 12.

Figure 2:
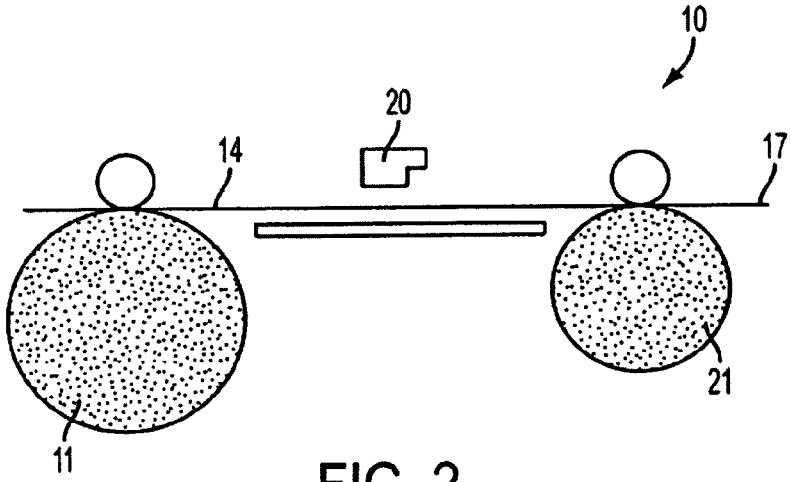
FIG. 2 PRIOR ART
FIG. 2 shows the arrangement of FIG. 1 in which the main, central region of the print media is passing through the print zone.

FIG. 2 shows the following stage in which the leading edge 17 of the print media 14 has passed through the pinch between an overdrive roller 21 and an associated pinch wheel 22. To undertake a printing operation, the print media 14 is driven to perform successive advance movements from left to right in FIG. 2. Between these advance movements, a scanning printhead 20 undertakes reciprocating movements in a direction perpendicular thereto to apply ink in swaths to the print media.

As in a conventional overdrive arrangement, the tangential speed of the surface 23 of the overdrive roller 21 is arranged to be slightly higher than the tangential speed of the surface 18 of the feed roller 11 so that the print media is subjected to a tensioning effect in the print zone to prevent the formation of cockle. A small amount of slippage is permissible between the surface 23 of the overdrive roller 21 and the print media 14.

Figure 3:
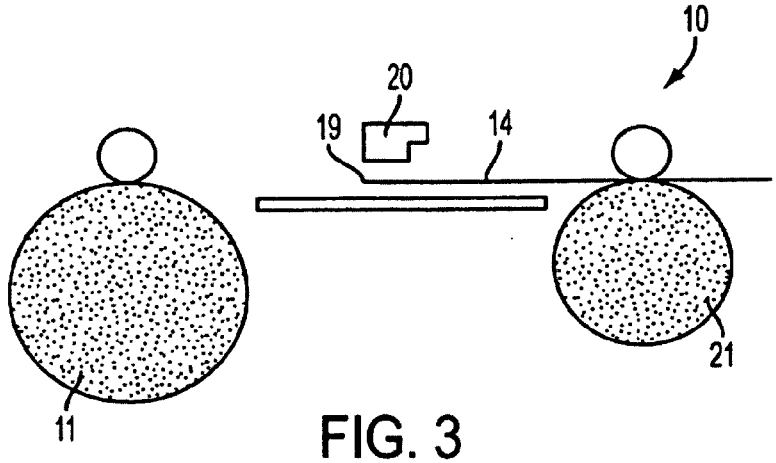
FIG. 3 PRIOR ART
FIG. 3 shows the arrangement of FIG. 1 in which the trailing edge of the print media is passing through the print zone.

FIG. 3 shows the final stage following a printing operation in which the trailing edge 19 of the print media 14 has left the pinch between feed roller 11 and pinch wheel 12 and the print media is advanced solely by the overdrive roller arrangement 21,22.

In printing operations as described above, in which full margins clear of printed matter are provided at the top and bottom of the print media 14 adjacent to its leading and trailing edges 17, 19 respectively, printing by printhead 20 only occurs when the print media is in its configuration shown in FIG. 2. During print media advance movements, the speeds of rollers 11 and 21 and the respective traction forces which they apply to the print media remain substantially constant so that the print media advance movements remain substantially uniform throughout printing. This leads to a good image quality with no overlapping of adjacent swaths, and no gaps between adjacent swaths. In a typical drive arrangement approximately 80% of the traction force for advancing the print media is supplied by the feed roller arrangement and approximately 20% by the overdrive roller arrangement.

However, if printing within the margins or bleed printing were required, printing by the printhead would also need to occur in the print media configurations shown in FIGS. 1 and/or 3. In these configurations, the forces applied by a single roller arrangement 11, 12 or 21,22 during media advance movements would differ from those forces applied in the configuration of FIG. 2. Thus banding and/or gaps would occur in the printing matter and print quality would deteriorate. In addition, the position of the print media would not be so precisely controlled as in the FIG. 2 configuration, so that unacceptable variations in the amount of print media advance could occur within the top and bottom margins.

As mentioned previously, aspects of the present invention seek to alleviate the effects of the above problems.

Figure 4:
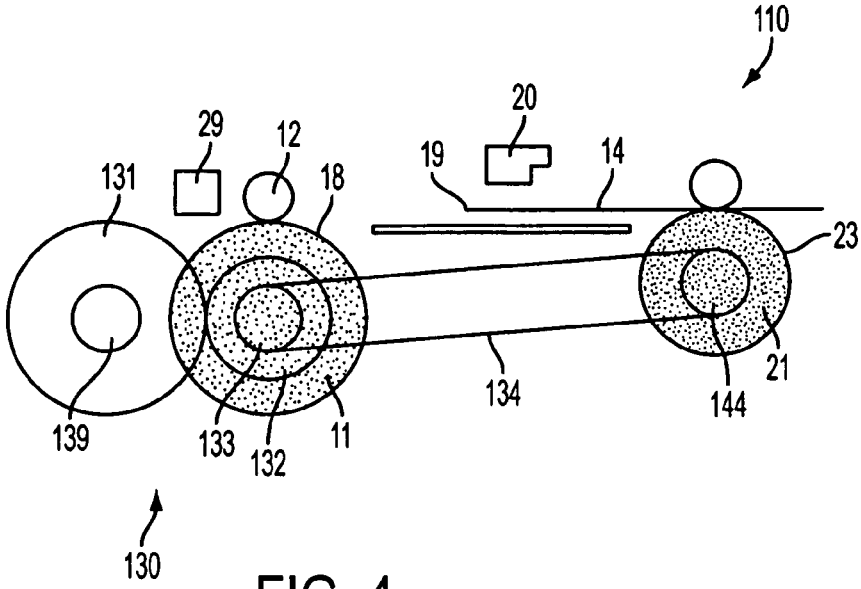
FIG. 4 shows a print media drive arrangement in accordance with a first embodiment of the present invention.

FIG. 4 shows a print media drive arrangement 110 in accordance with a first embodiment of the present invention in which printing by printhead 20 occurs in the bottom margin of print media 14, i.e. when the print media has become disengaged from the feed roller arrangement 11, 12 and is driven solely by the overdrive roller arrangement 21,22. The feed and overdrive rollers share a common drive arrangement 130. A gearwheel 131 rotated by a motor 139 engages a gearwheel 132 fixed to the axis of feed roller 11. Also fixed to the axis of feed roller 11 is a gearwheel 133 which is drivingly engaged by a toothed belt 134 which also drivingly engages a gearwheel 144 fixed to the axis of overdrive roller 21. The sizes of the various gear wheels and the rollers 11 and 21 themselves are selected to that the circumferential speed of the surface 23 of overdrive roller 21 is approximately 2% higher than the surface 18 of the feed roller 11, i.e. it advances 2% further during each advance movement.

An optical detector 29 is used to detect the passage of the trailing edge 19 of the print media 14 and to cause the drive arrangement 130 to change the drive parameters of the overdrive roller 21 as the print media becomes disengages from the feed roller arrangement 11, 12.

If overdrive roller 21 was operated with the same drive parameters as before the print media 14 become disengaged from feed roller arrangement 11, 12, then there would be an over-advance of the print media and banding would occur in the printed image. Accordingly, drive arrangement 130 reduces the size of each advance movement of the overdrive roller 21 by approximately 2% to achieve the same advance movement of the print media 14 as occurred in the configuration of FIG. 2. It will be appreciated that the advance movements of the feed roller 11 will be simultaneously reduced, but, since the feed roller is no longer in contact with the print media, this is not important.

The mechanical drive connection between rollers 11 and 21 may be provided by any suitable combination of gears, belts and shafts.

The reduced size of the overdrive roller 21 advance movements which are required may be determined empirically. A sample plurality of overdrive rollers 21 may be tested after manufacture to determine the appropriate advance. The driving parameters are averaged, and the results applied in all other drive arrangements. The remaining step errors are close to the required specifications for the print media drive arrangement. The associated errors remaining in the printed image can be hidden by adopting a robust print mode with suitable print masks in the corresponding region of the print media. To achieve further accuracy, one can calibrate each overdrive roller individually on a bench to determine the parameters to achieve the desired advance. In effect one calibrates the advance of the overdrive roller surface against the angular turn of the roller. This technique compensates for variations in diameter from a nominal value but is relatively time consuming.

Figure 5:
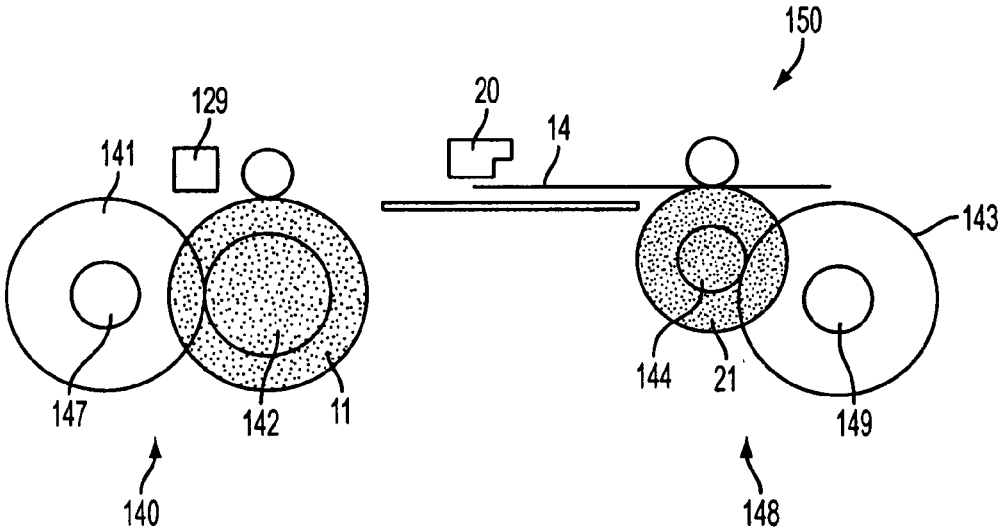
FIG. 5 shows a print media drive arrangement in accordance with a second embodiment of the present invention.

FIG. 5 shows a print media drive arrangement 150 in accordance with a second embodiment of the present invention in which the feed and overdrive rollers have separate drive arrangements 140, 148. Drive arrangement 140 comprises a gearwheel 141 which is rotated by a motor 147 and which engages a gearwheel 142 fixed to the axis of feed roller 11. Drive arrangement 148 comprises a gearwheel 143 which is rotated by a separate motor 149 and which engages a gearwheel 144 fixed to the axis of overdrive roller 21. As the print media 14 passes from the configuration corresponding to FIG. 2 to the configuration corresponding to FIG. 3, optical detector 129 detects the trailing edge 19 leaving the feed roller arrangement and causes drive arrangement 148 to slow down slightly as described in connection with FIG. 4.

An advantage of the arrangement shown in FIG. 5 is that the feed roller 11 does not need to change its parameters as the trailing edge 19 leaves the feed roller arrangement. Also the drive arrangement 148 has less inertia than the drive arrangement 130 of FIG. 4, so that the advance movements of the rollers can be controlled more accurately.

Instead of having separate motors, the gearwheels 141 and 143 may be driven by a common motor with variable gear ratio mechanisms.

Figure 6:
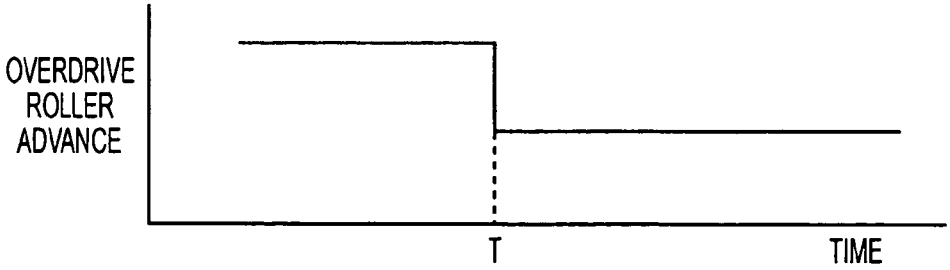
FIG. 6 is a diagram useful in explaining the operation of the embodiments of FIGS. 4 and 5.

FIG. 6 is a diagram showing the speed of the overdrive roller 21 in the embodiments of FIGS. 4 and 5 during advance periods before and after the transition T. It will be seen that there is substantially a step reduction in the speed (and hence the amount of the advance) at the moment when the print media becomes disengaged from the feed pinch.

Although the embodiments of FIGS. 4 and 5 substantially improve the image quality in the bottom margin, they are based on the ideal situation in which there is a clearly identifiable last swath printed with the print media still engaged by the feed roller and a clearly identifiable first swath printed with the print media solely in engagement with the overdrive roller. There are a number of problems with this approach. Firstly, in view of the delay between the optical detector 29 sensing the trailing edge 19 and the edge actually becoming disengaged from the feed roller arrangement, the exact instant of transition T is not known. This is due to an effect known as "tolerance stacking" caused by the accumulation of the individual small errors in media advance movements. Moreover, the print media can leave the pinch between pinch wheel 12 and feed roller 11 actually during an advance movement. In addition, if the print media is skewed relative to the platen 15 of the printer, it will leave different parts of the pinch at different times, so again no clear transition point exists.

Figure 7:
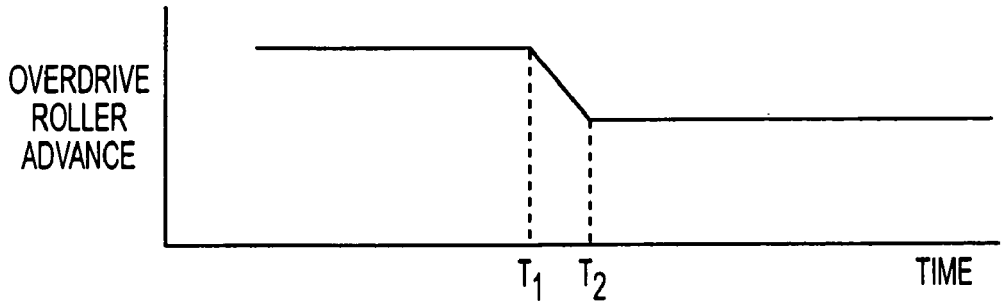
FIG. 7 is a diagram similar to FIG. 6 useful in explaining a modification.

A modification in accordance with the present invention will now be described in connection with FIG. 7 which is similar to FIG. 6 but shows the speed of the overdrive rollers when a dynamic switch of parameters is provided in the transition region. To allow for the factors that the position of the transition is uncertain and that it is spread out in time and spatially, there is a smooth transfer of control from both feed and overdrive rollers (mainly the feed roller) to the overdrive roller alone. Thus the speed of the overdrive roller during the advance periods is gradually reduced from the beginning T1 of the transition region to the end T2 of the transition region. Although some improvement can be made to the performance of the embodiment of FIG. 4 employing the modification of FIG. 7, it is much more effective at avoiding errors and removing defects when used in the embodiment of FIG. 5 in which the speed of the feed roller can be maintained at a constant value while the overdrive roller speed is gradually reduced. When the rollers are provided with encoders (as described in connection with FIG. 8 below), the smooth transfer is effected under the precise control of the encoders.

Figure 8:
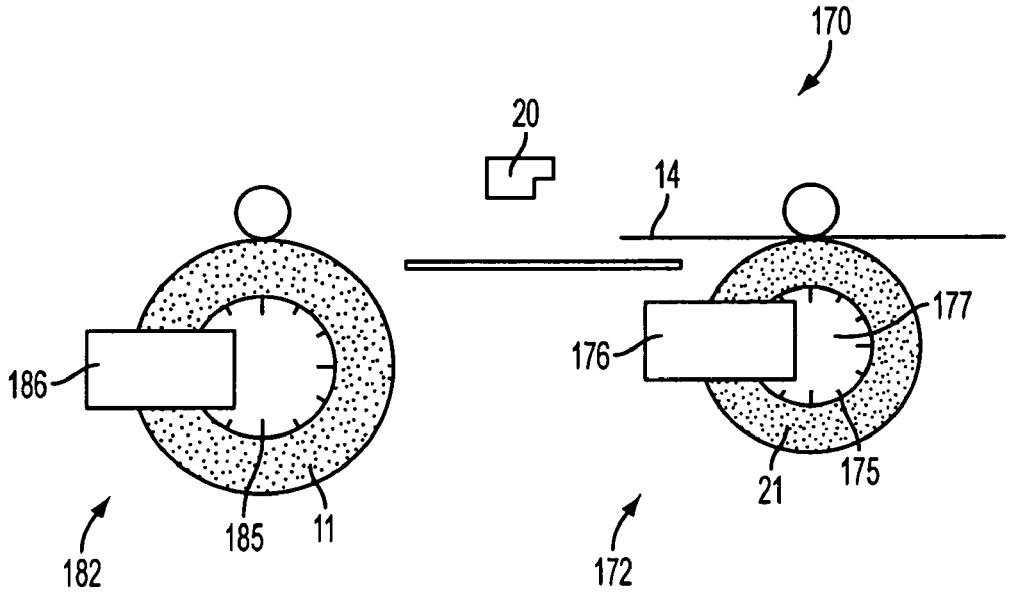
FIG. 8 shows a print media drive arrangement in accordance with a third embodiment of the present invention.

Although the above-described embodiments and modifications perform well, uncorrected errors can still remain caused by variations in the feed, transmission errors and the tolerance errors in the overdrive roller. FIG. 8 shows a print media drive arrangement 170 in accordance with a third embodiment of the present invention which seeks to further reduce the errors. This arrangement is similar to that shown in FIG. 4 except that a position encoder device 172 is provided having an encoder disc 175 coaxially attached to the overdrive roller 21. A common drive arrangement 130 is provided but is not shown in FIG. 8 for the purposes of clarity. The encoder disc 175 has a plurality of circumferential indicia 177 which are read by an optical reader 176 so that the precise position of the overdrive roller can be constantly monitored. Such encoder devices as well known and are conventionally used in connection with the feed rollers of print media drive arrangements, as described in connection with FIG. 1 of U.S. Pat. No. 6,168,333. During the phases of operation corresponding to FIGS. 1 and 2 above, the drive of feed roller 11 is driven by motor 139 under the precise control of such an encoder device 182 comprising encoder disc 185 and an optical reader 186.

In the embodiment of FIG. 8, the overdrive roller 21, during the phase of operation corresponding to FIG. 3, is driven by motor 139 under the precision control of the encoder device 172. The overdrive roller 21 is driven with different servo constants from the ones used for the feed roller 11. A reason for this is that there are more elastic parts between the motor 139 and the encoder device 172. This requires a careful change during the transition from the FIG. 2 configuration to the FIG. 3 configuration.

In a preferred method of operating the arrangement of FIG. 8, a final swath (i.e. the last expected swath to be printed before the print media leaves the feed roller pinch) is printed by printhead 20 under the control of the feed encoder 182. Before any further movement an initializing reading is taken from the overdrive encoder 172, and the next advance movement and also subsequent advance movements are based on readings from the overdrive encoder 172 alone.

An advantage of the embodiment of FIG. 8 is that the feedback signal provided by the encoder device 172 avoids the need for expensive gearing between motor 139 and the overdrive roller 21. The overdrive encoder 172 nevertheless permits precise positioning of the overdrive roller because, in practice, any detected errors can quickly be corrected at the end of a print media advance movement before the next swath is printed by printhead 20.

In a modification, the overdrive encoder device 172 may be replaced by an encoder device of the type disclosed in FIG. 2 of U.S. Pat. No. 6,168,333 in which a roller for driving the encoder is in direct contact with the print media itself. An advantage of this modification is that it avoids the possible adverse effects of any slippage between the overdrive roller 21 and the print media 14.

The rollers of print media drive arrangements usually suffer from a defect known as "wave", i.e. minor variations in the diameter as one travels around the circumference of a roller. To reduce the errors in the arrangement of FIG. 8 which still need to be compensated, this "wave" effect can be taken into account in the initial determination of the required advance of the overdrive roller. For this purpose an individual calibration of the overdrive roller 21 is required during production of the hardcopy device and this needs to be related to the angular position of the encoder disc 175. The "wave" defect is alternatively known as run out error and can be viewed as being due to the fact that a roller does not always rotate precisely about its centre. This produces non-linearity in the print media drive.

In most hardcopy devices, the overdrive rollers and in particular their associated mountings are not as precise as the feed rollers. This is because deliberate slippage is required during normal printing operations, as described previously, and so the overdrive rollers are relatively loosely mounted so as not to cause smearing of ink on the print media as it passes through. Because of this, cheaper components tend to be used for overdrive rollers than for feeder rollers, so wave and run out errors occur more frequently in connection with overdrive rollers.

Figure 9:
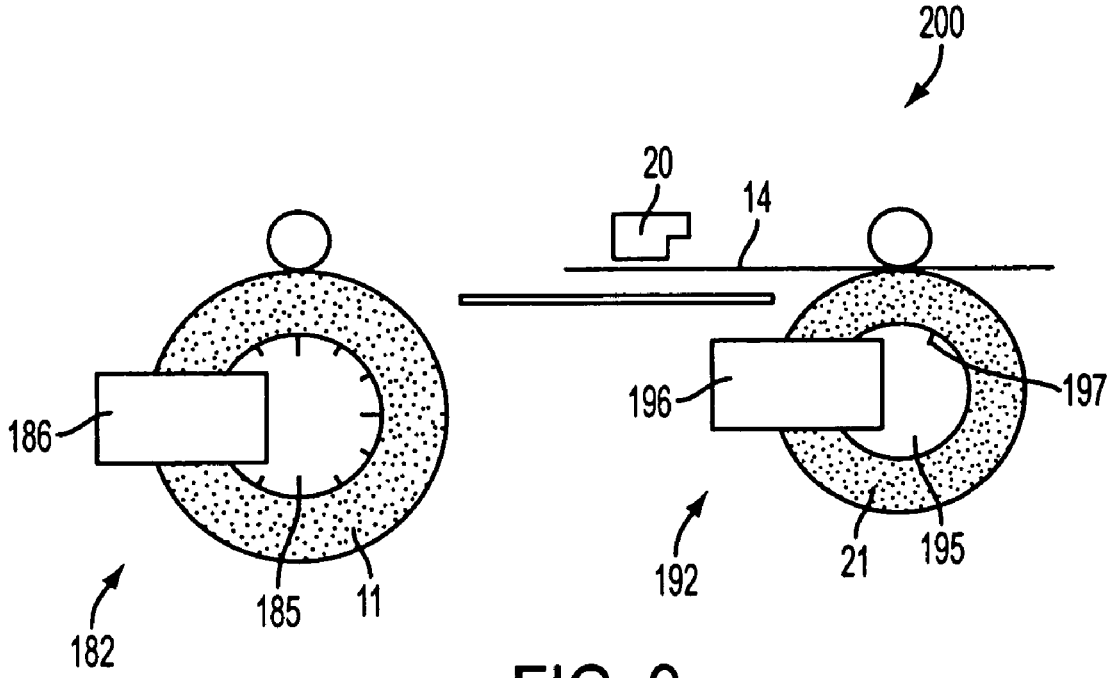
FIG. 9 shows a print media drive arrangement in accordance with a fourth embodiment of the present invention.

A fourth embodiment of the present invention will now be described with reference to FIG. 9 which also takes this "wave" effect into account. During the phases of operation corresponding to FIGS. 1 and 2, the media advance is controlled by an encoder device 182 associated with the feed roller 11 as shown in FIG. 8. FIG. 9 shows a print media drive arrangement 200 with a simplified, inexpensive encoder device 192 comprising a disc 195 fixed to overdrive roller 121 and an optical reader 196. Instead of indicia 177, disc 195 has a single marking 197 known as a flag.

When, in the phase of operation corresponding to FIG. 3, reader 196 detects the passage of flag marking 197, a signal is passed to the control for motor 139. Since the flag marking is associated with a particular position on the surface of overdrive roller 21, it enables compensation for the calibrated wave or run out to be undertaken, and the control is reset each time the flag passes.

In between the points in time at which the marking 197 is detected, an estimate is made of the desired speed of the drive motor 139 by referring to a look-up table. The look-up table is created during production of the hardcopy device for the individual overdrive roller 21 so that the roller's imperfections are automatically taken into account when printing in the bottom margin. Thus the look-up table converts the amount of rotation of encoder disc 195 into appropriate control of the drive motor 139 to produce a desired amount of arcuate advance of a part of the surface of the overdrive roller 121.

Compared to the embodiment of FIG. 8, the embodiment of FIG. 9 has the advantage that, instead of encoder device 172, it only requires a relatively simple and cheap encoder device 192.

In the embodiments of FIGS. 8 and 9, the encoder discs 175, 195 may be omitted, with the encoder markings 177, 197 being located on the circular end surface of the overdrive roller itself.

The above-described embodiments relate to achieving good-quality printing in the bottom margin of a print media. However, arrangements according to the present invention can also be used to improve the quality of printing in the top margin of a print media.

Figure 10:
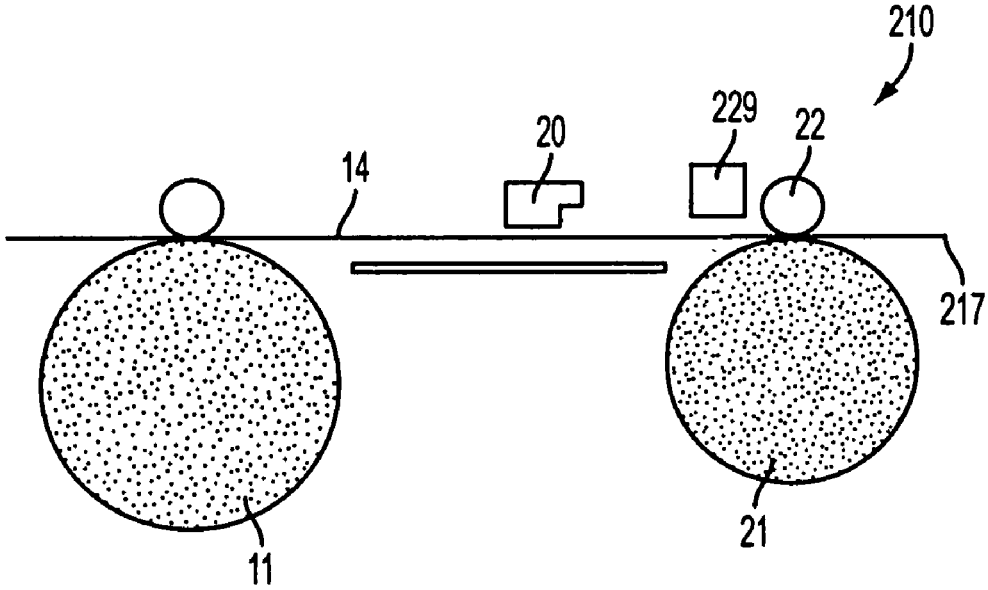
FIG. 10 shows a print media drive arrangement in accordance with a fifth embodiment of the present invention.

In accordance with a fifth embodiment of the present invention, a print media drive arrangement 210, FIG. 10, comprises an optical detector 229 for detecting when the leading edge 217 of print media 14 enters the pinch between overdrive roller 21 and associated pinch wheel 22. Because the overdrive roller contributes to the drive of the print media in the configuration corresponding to FIG. 2, additional drive is required from feed roller 11 while the print media is still in the FIG. 1 configuration in which it is driven solely by the feed roller pinch. Accordingly, the driving parameters for the drive of feed roller 11 are set at a slightly higher level until optical detector 229 indicates that the overdrive pinch is about to contribute to the drive. As with the previously-described embodiments the transfer can be arranged to be substantially instantaneous or gradual.

Various modifications can be made to the above-described embodiments. For example, instead of being sensed by optical detectors 29,229, the leading edges 17,217 and trailing edges 19 may be sensed by other means, e.g. capacitatively or electro-mechanically or by means of a media position counter connected to the drive mechanism.

The features and modifications of the various embodiments described can be interchanged or combined as appropriate.

The above embodiments can be used in scanning type printers in which a printhead scans across the print media in a direction perpendicular to that of print media advance, or in printers with fixed printheads, e.g. so-called page wide arrays. They are specially suitable for wide format printers.

Arrangements according to the invention can also be used in other types of hardcopy such as scanners, photocopiers and facsimile machines.

What is claimed is:

1. An arrangement for driving a print media through a hardcopy apparatus comprising a first roller member for feeding the print media to a print zone, a second roller member for removing the print media from the print zone, a drive device arranged to drive the first roller member with first respective drive parameters as the print media passes through the print zone, and arranged to drive the second roller member with second respective drive parameters as the print media passes through the print zone, wherein the drive device is arranged to drive said first roller member with different drive parameters as a leading edge of said print media passes through the print zone.

2. An arrangement according to claim 1 wherein said drive parameters include a speed of the respective roller member during print media advance movements.

3. An arrangement according to claim 1 wherein said drive parameters include an amount of rotation of the respective roller member during print media advance movements.

4. An arrangement according to claim 1 wherein said drive parameters include a tractional force applied by the respective roller to the print media during media advance movements.

5. An arrangement according to claim 1, wherein said drive parameters are changed gradually.

6. An arrangement according to claim 1 and further comprising a detector for detecting the leading edge of said print media as said leading edge leaves the print zone, said detector causing said drive device to change at least said first drive parameters.

7. An arrangement for driving a print media through a hardcopy apparatus comprising a first roller member for feeding the print media to a print zone, a second roller member for removing the print media from the print zone, and a drive device for driving the first and second roller members at a predetermined transmission ratio as the print media passes through the print zone wherein said transmission ratio is varied as a leading edge of said print media passes through the print zone.

8. An arrangement according to claim 7 wherein said transmission ratio is varied gradually as a leading edge of said print media passes through the print zone.

9. A hardcopy device comprising at least one printhead arranged to apply ink to a print media and means for moving a print media past said printhead, said media moving means comprising a first roller member for moving the print media towards said printhead and a second roller member for moving the print media away from said printhead, drive means for operating said roller members with respective drive parameters, the arrangement being such that, when a leading edge of a print media is between said roller members, at least one of said drive parameters is different from when a print media extends fully between said roller members.

10. A method of printing the margin of a print media passing through the print zone of a hardcopy apparatus, comprising moving the print media into the print zone with first drive parameters, moving the print media out of the print zone with second drive parameters, and changing at least one of said drive parameters when a leading edge of the print media leaves the print zone.

11. A method according to claim 10 wherein at least one of said parameters is changed in a gradual manner.

12. An arrangement for driving a print media through a hardcopy apparatus comprising a first roller member for feeding the print media to a print zone, a second roller member for removing the print media from the print zone, a drive device arranged to drive the first roller member with first respective drive parameters as the print media passes through the print zone, and arranged to drive the second roller member with second respective drive parameters as the print media passes through the print zone, the drive device being arranged to drive at least one of the roller members with different drive parameters as an edge of said print media passes through the print zone, wherein the second roller member has a position encoder device for controlling said drive device, and wherein a look-up table is provided to convert the amount of rotation of said encoder device into appropriate control of said drive device to produce a desired length of arcuate advance of a part of the surface of the second roller.

13. An arrangement according to claim 12 wherein the encoder device provides a substantially continuous signal during rotation of the second roller member.

14. An arrangement according to claim 12 wherein the encoder device provides an intermittent signal during rotation of the second roller member.

15. An arrangement according to claim 12 wherein said drive parameters include a speed of the respective roller member during print media advance movements.

16. An arrangement according to claim 12 wherein said drive parameters include an amount of rotation of the respective roller member during print media advance movements.

17. An arrangement according to claim 12 wherein said drive parameters include a tractional force applied by the respective roller to the print media during media advance movements.

18. An arrangement according to claim 12 wherein said drive parameters are changed gradually.

19. In an arrangement for driving a print media through a hardcopy apparatus comprising a first roller member for feeding the print media to a print zone, a second roller member for removing the print media from the print zone, a drive device arranged to drive the first roller member with first respective drive parameters as the print media passes through the print zone, and arranged to drive the second roller member with second respective drive parameters as the print media passes through the print zone, the drive device being arranged to drive said second roller member with different drive parameters as a trailing edge of said print media passes through the zone, wherein the second roller member has a position encoding device for controlling said drive device, a method of printing adjacent the trailing edge wherein, as the trailing edge of said media reaches the print zone, a print media advance movement is undertaken controlled by a drive mechanism for the first roller member, the current setting of said position encoder device is then determined, and subsequent media advance movements are undertaken controlled by said position encoder device.

20. An arrangement for driving a print media through a hardcopy apparatus comprising a first roller member for feeding the print media to a print zone, a second roller member for removing the print media from the print zone, a drive device arranged to drive the first roller member with first respective drive parameters as the print media passes through the print zone, and arranged to drive the second roller member with second respective drive parameters as the print media passes through the print zone, the drive device being arranged to drive at least one of the roller members with different drive parameters as an edge of said print media passes through the print zone, wherein the arrangement further comprises a detector for detecting the trailing edge of said print media as said trailing edge enters the print zone, said detector causing said drive device to change at least said second drive parameters, and wherein said first roller member has a first position encoder device for controlling said drive device and said second roller member has a second position encoder device for controlling said drive device.

21. An arrangement according to claim 20 wherein said first position encoder device provides a substantially continuous signal during rotation of said first roller member and said second position encoder device provides an intermittent signal during rotation of said second roller member.

* * * * *